United States Patent [19]

Gould et al.

[11] 4,422,926

[45] Dec. 27, 1983

[54] SEPARATING BASIC ASPHALTENES USING BRONSTED ACID TRANSITION METAL OXIDE ACID CATALYSTS

[75] Inventors: Kenneth A. Gould, Berkeley Heights; Dane C. Grenoble, Plainfield; Lawrence L. Murrell, South Plainfield; Wim J. M. Pieters, Morristown, all of N.J.

[73] Assignee: Exxon Research and Engineering Co., Florham Park, N.J.

[21] Appl. No.: 305,265

[22] Filed: Sep. 24, 1981

[51] Int. Cl.[3] ..... C10G 11/04; C10G 25/00; C10G 25/12

[52] U.S. Cl. ..... 208/86; 208/120; 208/122; 208/123; 208/309

[58] Field of Search ..... 208/86, 91, 122, 123, 208/120, 309, 254 R, 251 R, 310 R, 310 Z

[56] References Cited

U.S. PATENT DOCUMENTS

| | | | |
|---|---|---|---|
| 2,956,004 | 10/1960 | Conn et al. | 208/91 |
| 3,530,066 | 9/1970 | Kuwata et al. | 208/309 |
| 4,069,268 | 1/1978 | Siskin et al. | 208/134 |
| 4,090,948 | 5/1978 | Schwarzenbek | 208/74 |
| 4,090,951 | 5/1978 | Smith | 208/91 |
| 4,123,379 | 10/1978 | Gates et al. | 252/184 |
| 4,125,457 | 11/1978 | Brennan et al. | 208/254 R |
| 4,137,154 | 1/1979 | Audeh | 208/254 R |
| 4,233,139 | 11/1980 | Murrell et al. | 208/112 |
| 4,244,811 | 1/1981 | Grenoble et al. | 208/122 |

OTHER PUBLICATIONS

Yen, *Shale Oil, Tar Sands, and Related Fuel Sources*, Am. Chem. Soc. (1976) pp. 30–33.

*Primary Examiner*—Delbert E. Gantz
*Assistant Examiner*—O. Chaudhuri
*Attorney, Agent, or Firm*—Edward M. Corcoran

[57] ABSTRACT

Basic asphaltenes are selectively removed from asphaltene-containing hydrocarbon feeds by contacting the feed with a transition metal oxide solid acid catalyst exhibiting Bronsted acidity. The catalyst selectively adsorbs the basic asphaltenes. The catalysts will comprise a catalytic metal component selected from the group consisting essentially of oxides of (a) tungsten, niobium and mixtures thereof and (b) mixtures of (a) with tantalum, hafnium, chromium, titanium, zirconium and mixtures thereof, supported on pyrogenic alumina. Asphalt-laden catalyst is separated from the feed, the asphaltenes adsorbed thereon are cracked off in the presence of steam and the catalyst is regenerated and recycled back to the adsorption zone.

19 Claims, 1 Drawing Figure

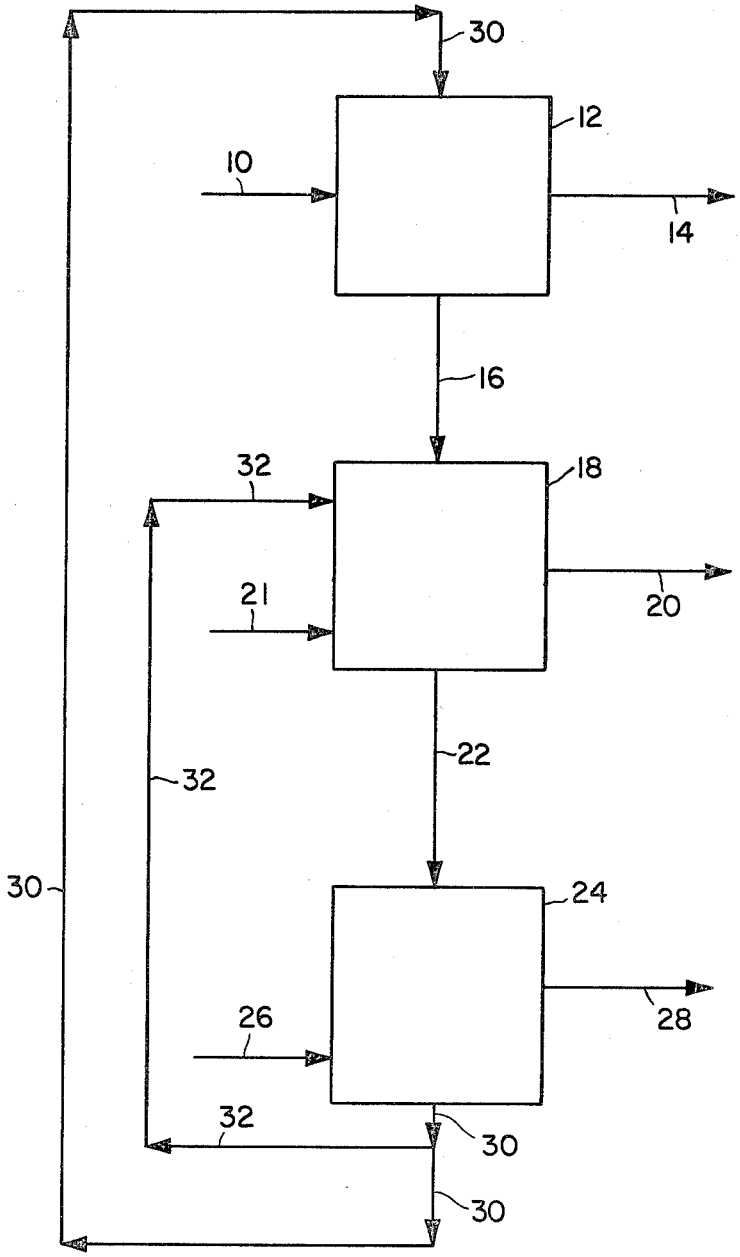
30
12
10
14
16
32
18
21
20
22
32
30
24
26
28
32
30
30

SEPARATING BASIC ASPHALTENES USING BRONSTED ACID TRANSITION METAL OXIDE ACID CATALYSTS

BACKGROUND OF THE INVENTION

1. Field of the Invention

This invention relates to selectively adsorbing basic asphaltenes on Bronsted acid catalysts comprising at least one transition metal oxide supported on an alumina support. More particularly, this invention relates to a process for the selective removal of basic asphaltenes from an asphaltene-containing hydrocarbon feed by contacting said feed with a solid, Bronsted acid catalyst comprising at least one transition metal oxide supported on a pyrogenic, γ-alumina support to produce a feed of reduced basic asphaltene content and a catalyst containing basic asphaltenes.

2. Background of the Disclosure

Conventional hydrodesulfurization, hydrodenitrogenation, hydrocracking, cat cracking, reforming and other hydroconversion processes cannot be used on feeds containing appreciable amounts of asphaltene materials due to coking and deactivation off the catalyst by the asphaltenes. Basic asphaltenes are the most troublesome in this regard.

It is known in the art that asphaltenes can be separated into basic and non-basic fractions using mineral acid separation techniques. Basic asphaltenes have been precipitated from various crude oils by potentiometric titration with perchloric acid and there are earlier reports of the use of potentiometric titration to determine basic nitrogen (Nicksic, S. W. and Jeffries-Harris, M. J., Inst. Petrol., 54 (532), 107–114 (1968)). H. Sternberg developed a technique for separating basic and non-basic asphaltenes from coal liquids by first dissolving the asphaltenes in toluene, followed by saturating the solution with anhydrous HCl which precipitates a basic asphaltene-HCl complex from the solution. The precipitate is filtered and the basic asphaltenes are recovered by treating the asphaltene-HCl complex with caustic solution (Sternberg, H. W. Raymond, R., and Schweighardt, F. K., Science, 188, 49 (1975)). In this technique, the non-basic asphaltenes remain in the original toluene solution and are recovered from the filtrate by evaporating off the toluene.

Increasing world petroleum consumption and declining availability of high quality crude oils has forced both producers and refiners of petroleum alike to turn more and more to low quality, heavy crudes having relatively high residuum and concomitant high asphaltene contents. Further, synthetic feeds derived from Alberta Tar Sands, Cole Lake Crude, coal liquids, Venezuelan tar sands and the like also contain appreciable amounts of asphaltenes. Therefore, there is a need for processes which can readily remove at least a portion of the asphaltenes, and particularly the basic asphaltenes, from feeds containing same to permit further processing of the asphaltene-reduced feed into useful products such as chemicals, solvents, fuels and lubricating oils. It would be particularly beneficial if such processes could also make liquid products out of the separated basic asphaltenes.

U.S. Pat. No. 3,691,063 discloses employing solid acid catalysts, such as silica-alumina, in a guard case operated at from 600°–1,000° F. to remove metals and asphaltenes from heavy feeds prior to hydrocracking same. Under these temperature conditions some of the adsorbed asphaltenes are cracked in-situ in the guard case. This in-situ cracking tends to coke the catalyst therein, thereby reducing both its adsorption capacity and selectivity for the basic asphaltenes. U.S. Pat. Nos. 2,944,002 and 2,432,644 disclose the use of solid acid catalysts in guard cases for removing metal and nitrogen-containing catalyst contaminants from feeds being fed to cat crackers. However, none of the processes disclosed in these two patents permits an asphalt-containing feed to be fed to the guard case. In fact, U.S. Pat. No. 2,944,002 repeatedly teaches that the feed going to the guard case must first be deasphalted if it is an asphaltene-containing feed.

SUMMARY OF THE INVENTION

It has now been discovered that the basic asphaltenes present in asphalt-containing hydrocarbon feeds or oils are selectively adsorbed onto transition metal oxide catalysts exhibiting primarily Bronsted acidity. In order for the catalyst to exhibit Bronsted acidity, the transition metal oxide catalytic component must be supported on a suitable alumina support. Thus, the present invention relates to a process for producing an oil of reduced basic asphaltene content by contacting the feed, in an adsorption zone, with a Bronsted acid catalyst comprising at least one transition metal oxide catalytic component supported on an alumina support. The alumina support is a critical and essential feature of the catalysts useful in the process of this invention, and must be one which, when combined with the transition metal oxide component, results in a catalyst which exhibits primarily Bronsted acidity. Pyrogenic alumina meets this criteria. Contacting the feed with the catalyst at a temperature below about 575° F. avoids cracking the asphaltenes in the adsorption zone and produces an asphaltene-reduced feed and a basic asphaltene-containing catalyst which must be separated from the feed. The basic asphaltenes are cracked off the catalyst, preferably in the presence of steam to reduce coke formation, after which the catalyst is regenerated and recycled back to the adsorption zone. Optionally, contacting at temperatures higher than about 575° F. will result in in-situ cracking of the asphaltenes in the adsorption zone. In this case a portion of the catalyst may be continuously withdrawn from the adsorption zone, with subsequent cracking, regeneration and recycling back to the adsorption zone. Alternatively, one can employ alternating adsorption zones.

The solid acid catalysts having primarily Bronsted acidity useful in the process of this invention will comprise oxides of one or more metals selected from the group consisting essentially of (a) tungsten, niobium and mixtures thereof and (b) mixtures of (a) with tantalum, hafnium, chromium, titanium, zirconium, and mixtures thereof on an alumina support. Preferably the support will comprise a pyrogenic γ-alumina and still more preferably the support will comprise a pyrogenic γ-alumina that has been formed by the flame hydrolysis of an aluminum halide, such as aluminum chloride. In a preferred embodiment of this invention the catalyst is calcined at a temperature of at least about 150° C. prior to being contacted with the asphalt-containing feed. This is done in order to remove adsorbed water from its surface which would reduce its adsorptive capacity for basic asphaltenes.

BRIEF DESCRIPTION OF THE DRAWINGS

The attached FIGURE is a flow diagram of a preferred embodiment of a process of this invention, including regeneration and recycling of the catalyst back to the adsorption zone.

DETAILED DESCRIPTION

Transition metal oxide solid acid catalysts similar to those useful in the process of this invention and the methods useful in preparing them are known in the art and may be found, for instance, in U.S. Pat. Nos. 4,233,139; 4,244,811; and 4,269,737; the disclosures of which are incorporated hereby by reference. These catalysts are unexpectedly coke tolerant and can function as acid cracking catalysts in the presence of much larger quantities of coke than conventional silica-alumina cracking catalysts. The critical difference or distinction between the catalysts disclosed in these references and those useful in the process of this invention resides in the fact that the catalysts useful in the process of this invention have primarily Bronsted acidity. This Bronsted acidity is due to the use of a pyrogenic alumina support. The methods of catalyst preparation, etc. are the same. In contrast to the catalysts useful in the process of this invention, catalysts comprising transition metal oxides on conventional alumina are chemically different from catalysts comprising transition metal oxides on pyrogenic alumina, because the former have primarily Lewis-type acid centers, while the latter have primarily Bronsted-type acid centers. The catalysts of this invention have been found to be much more stable in the presence of steam and produce significantly less coke than similar catalysts having primarily Lewis acidity. By primarily Bronsted acidity is meant that at least about 50% of the acid sites are Bronsted, preferably at least about 70% and still more preferably at least about 80%.

As has heretofore been stated, it is essential that the alumina support material be one which exhibits primarily Bronsted acidity when combined with the transition metal oxide component. One such type of alumina has been found to be a pyrogenic alumina. Pyrogenic alumina includes aluminas that have been formed by the flame hydrolysis of an aluminum halide, particularly anhydrous aluminum chloride. In one process, hydrogen is burned in a furnace to produce water which then hydrolyzes gaseous $AlCl_3$ in the presence of the flame to give alumina and HCl. The hydrolysis is instantaneous. This process is disclosed in, for example, U.S. Pat. Nos. 2,990,249; 3,006,738; and 3,130,008. Aluminas produced by this flame hydrolysis process have exceptional purity and extremely fine particle size. They are primarily $\gamma$-$Al_2O_3$ and the fine particles have virtually no porosity, the surface area being mainly on the external surface. Another method for making a pyrogenic alumina is that disclosed in U.S. Pat. No. 3,449,072 wherein an aluminum halide (such as aluminum chloride) is reacted directly with oxygen in a high temperature plasma, such as an argon or nitrogen plasma.

Those skilled in the art know that solid acid catalysts have two types of acidity or acid sites, Lewis and Bronsted. Lewis acid sites are believed to be coordinatively unsaturated centers which are electron acceptors, whereas Bronsted acid sites are proton donors. Those skilled in the art also know that one of the most widely used and accepted methods for determining the strength and amount of acidity or acid sites on cracking catalysts is the Benesi method employing titration with n-butyl amine (H. A. Benesi, J. Amer. Chem. Soc. 89, 5490 (1956)). However, the Benesi method will not distinguish between Lewis and Bronsted acid sites.

An effective way of determining the difference between Lewis and Bronsted acid sites is to titrate a sample of solid acid with a solution of 2,6-dimethylpyridine in toluene which selectively reacts with the Bronsted acid sites. This particular amine does not react with Lewis sites due to steric hindrance. After the Bronsted acid sites have reacted with the 2,6-dimethylpyridine, the sample of solid acid is then reacted with n-butyl amine using the Benesi method which yields the number of Lewis acid sites. The number of Bronsted acid sites is then determined by the difference between the Lewis acidity measured in this manner and the total acidity measured by the Benesi method on a sample that has not been treated with the 2,6-dimethylpyridine.

It should be noted that only those acid sites having a Hammett acidity coefficient of $Ho \leqq -8.2$ are considered to be strong acid sites and it is these very strong acid sites which are believed to be primarily responsible for catalytic cracking reactions.

As herinbefore stated, the catalysts useful in the process of this invention have primarily Bronsted acidity and comprise a catalytic metal oxide component selected from the group consisting essentially of the oxides of (a) tungsten, niobium and mixtures thereof and (b) mixtures of (a) with tantalum, hafnium, chromium, titanium, zirconium and mixtures thereof supported on an alumina support, preferably a pyrogenic alumina support and still more preferably a pyrogenic $\gamma$-alumina support. The alumina support may contain other refractory metal oxides such as zirconia, boria, thoria, magnesia, zirconium titanate, titania, chromia, silica, kieselguhr and mixtures thereof, etc. Thus, the support will preferably comprise a pyrogenic alumina and most preferably a pyrogenic $\gamma$-alumina. If the support comprises a mixture of silica and alumina, the silica content thereof will be less than 50 wt. % of the alumina content. The support should have a high surface area in the region of from about 20 to 500 $m^2/g$, preferably 40 to 200 $m^2/g$, and more preferably at least about 100 $m^2/g$ prior to the deposition of the transition metal oxide salt precursor used in forming the catalyst. These surface areas are as measured by the Brunauer-Emmett-Teller (BET) method.

The catalysts may also advantageously contain minor amounts of various promoter materials selected from one or more oxides of Group IIA. Particularly preferred are oxides of barium, calcium, strontium and mixtures thereof. These promotor materials, in the form of precursor salts, can be incorporated into the carrier simultaneously with the transition metal oxide precursor salt, or sequentially (the order of addition being merely a matter of choice), or may be coprecipitated onto the support with the transition metal oxide precursor salts. Alternatively, they may be added subsequent to the formation of the catalyst composite. If used at all these promoters will be present in an amount ranging from about 0.01 to 4.0 wt. % promoter based on total catalyst composition wherein the amount of promoter metal oxide ranges from 0.1% to 4%, preferably, 0.1% to 0.5%.

These catalysts may be prepared by techniques well-known in the art such as incipient wetness, impregnation, etc., the choice being left to the practitioner.

In co-pending application Ser. No. 305,267 filed simultaneously herewith, solid acids, such as well-known acid cracking catalysts including silica/alumina are employed to selectively adsorb basic asphaltenes from an asphaltene-containing feed, at a temperature below about 575° F. in order to avoid cracking of the asphaltenes in the adsorption zone. However, ordinary solid acids such as the well-known silica/alumina acid cracking catalysts are not resistant to steaming. That is, steaming destroys the acid sites resulting in destruction of both the adsorptive ability and cracking ability of the catalyst, whereas the catalysts useful in the process of this invention are extremely resistant to high temperature (i.e., ≧600° C.) steaming. In some cases it may be preferred to subject the catalysts of this invention to high temperature steaming prior to use in the process of this invention.

Co-pending application Ser. No. 205,456 filed simultaneously herewith discloses the processes of this invention using catalysts similar to the catalysts of this invention, except that the support comprises a conventional $\gamma$-$Al_2O_3$, the catalysts exhibit Lewis acidity, are not as resistant to steaming and produce more coke when used for cracking.

Asphalt-containing hydrocarbon feeds or oils useful in the process of this invention include any naturally occurring, asphalt-containing mineral oils and fractions thereof such as whole and topped crude oils, vacuum and atmospheric residua, etc. as well as asphalt-containing synthetic feeds or oils derived from the liquefaction of coal, from tar sands, Cold Lake crude, etc. The process of this invention is sensitive to the presence of water. Therefore, it is preferred that the feed not contain too much water, because the solid acid will preferentially adsorb the water at the expense of adsorbing the basic asphaltenes. Hence, the water content of the feed, if any, should be appreciably lower than the basic asphaltene content to the feed. It is preferred that the water content of the feed be less than about 1 wt. %, unless one wishes to control the basic asphaltene adsorption onto the catalyst via control of the water content of the feed in the adsorption zone.

In the process of this invention, the temperature, pressure and residence time of the asphalt-containing feed in the adsorption zone are not particularly critical as long as the temperature is below about 575° F. if one desires to avoid cracking in the adsorption zone and as long as the desired degree of removal of basic asphaltenes from the feed is achieved. In general, this means that the maximum temperature employed in the adsorption zone will be no greater than about 575° F., preferably no greater than about 550° F., and still more preferably no greater than about 500° F. It has been found that the solid acid catalysts can adsorb up to about 20% of their weight of basic asphaltenes and, if desired, substantially all of the basic asphaltenes may be removed from the feed in the adsorption zone. Alternatively, if it is desired to have in-situ cracking of the adsorbed asphaltenes occur in the adsorption zone, then the adsorption zone will operate at a temperature above 575° F., preferably above about 600° F., and still more preferably above about 650° F. The minimum pressure is that required to force the asphaltene-containing feed through the adsorption zone.

Thus, the conditions of pressure, temperature and space velocity may be adjusted to suit ones needs. In general, however, the pressure in the adsorption zone will be at least about 25 psig, the temperature will range from about 200°-500° F. (for the case of adsorption only) or above about 600° F. (if in-situ cracking is desired) with a residence time of the feed in the adsorption zone of from about 2-600 minutes and a liquid hourly space velocity of from about 0.1 to 30 V/V/hr. The catalyst may be in the form of a fixed or fluid bed or one may use a slurry-plus-settler technique wherein the solid acid catalyst and asphalt-containing feed pass cocurrently through the adsorption zone and are then passed to a settling zone to separate the catalyst containing the adsorbed basic asphaltenes from the basic asphaltene-reduced feed. Alternatively, the slurry may be sent to hydroclones or filtration means to separate the basic asphaltene-laden catalyst from the feed. In any event, the catalyst containing the adsorbed basic asphaltenes must be periodically separated from the feed. The basic asphaltenes may then be cracked off to produce liquid and coke, with the coke-laden catalyst regenerated, calcined and then recycled back to the adsorption zone. The asphaltenes may be cracked or burned off in the presence of steam to reduce coke formation. However, it should be noted that cracking the asphaltenes off the catalyst, as opposed to burning, will result in recovering more liquid product from the asphaltenes.

The catalyst will typically be regenerated in a regenerator at a pressure below about 150 psig, at a temperature of from about 1400°-2800° F. (760°-1535° C.), preferably at a temperature greater than about 1500° F., more preferably at a temperature in a range of about 1600° to 1900° F. and most preferably at a temperature in the range of about 1700° to 1800° F. The coked catalyst may be introduced into the regenerator in the presence of steam and an oxygen containing gas, such as air, to produce a low BTU value fuel gas containing $H_2$ and CO.

DESCRIPTION OF A PREFERRED EMBODIMENT

Referring to the FIGURE, an asphaltene-containing feed, such as a crude oil derived from the Cold Lake region of Canada, is heated by means not shown to a temperature of about 300° F. and passed via line 10 to adsorption zone 12 at a pressure of about 50 psig. Adsorption zone 12 operates at a temperature of about 300° F., a pressure of about 50 psig and contains a catalyst having primarily Bronsted acidity comprising 10 wt. % $WO_3$ on a pyrogenic $\gamma$-alumina. The residence time of the oil in adsorption zone 12 will be less than about 1 hour and the ratio of oil to catalyst will generally range from about 1 to 10 volumes of oil to one volume of catalyst, the combination being sufficient for at least about 90 wt. % of the basic asphaltenes present in the feed to be adsorbed onto the solid acid catalyst to produce an oil of reduced basic asphaltene content. The basic asphaltene-reduced oil or feed is removed from adsorption zone 12 via line 14 and sent to further upgrading processes such as hydrocracking, catalytic cracking, hydrorefining, etc. Catalyst particles laden with adsorbed basic asphaltenes are continuously withdrawn from zone 12 via line 16 and passed to cracking zone 18. Cracking zone 18 operates at a temperature above about 750° F. and at a pressure ranging from atmospheric to about 50 psig. In cracking zone 18, the basic asphaltenes are catalytically cracked off the catalyst particles in the presence of steam entering via line 21, to produce liquid and gaseous products which are removed from zone 18 via line 20. This cracking also produces a coked catalyst. Heat is supplied to zone 18 via hot, regenerated catalyst particles entering zone 18 via line 32. Coked catalyst particles are removed from cracking zone 18, via line 22 and passed to catalyst regeneration zone 24 which operates at a temperature of from about 1600°–1900° F. Air and steam are passed into regeneration zone 24, via line 26 to burn the coke off the catalyst and simultaneously produce a low BTU value fuel gas which is removed from regeneration zone 24 via line 28. A portion of the hot, regenerated catalyst is removed from zone 24 via line 30, cooled by means not shown and recycled back to adsorption zone 12. The rest of the hot catalyst is recycled back to zone 18 via line 32.

The invention will be further understood by reference to the examples below.

EXAMPLES

Examples 1–5 are presented to establish the fact that solid acids selectively adsorb basic asphaltenes from mixtures of basic and non-basic asphaltenes and other materials, while Example 6 establishes the moisture sensitivity of solid acids to adsorptive selectivity for basic asphaltenes.

EXAMPLE 1

This example establishes the fact that solid acids selectively adsorb basic asphaltenes from a mixture of basic and non-basic asphaltenes. The asphaltenes used in this experiment were precipitated from a 1050° F.+ vacuum residuum obtained from a Canadian Cold Lake crude and also from a Tia Juana crude using standard deasphalting procedures employing n-heptane to effect the precipitation. A solution of 3 wt. % of these asphaltenes in toluene was made and a basic/non-basic split made using HCl precipitation according to the Sternberg technique previously discussed. The results are shown in Table 1. Next, samples of commercial silica/alumina cracking catalysts obtained from Grace Chemical Company, containing 13% $Al_2O_3$(DA-1) and 25% $Al_2O_3$(Hi-Al) were calcined at 500° C. for 16 hours and stored in a nitrogen-purged dry box. Toluene solutions of the precipitated asphaltenes were prepared by dissolving 30 grams of the asphaltenes in 300 ml of toluene under nitrogen and stirring for two hours. 120 grams of each catalyst was added to each solution of 30 grams of asphaltenes in the 300 ml of toluene and the mixture or slurry stirred for two hours at ambient temperature under a blanket of nitrogen. The toluene was removed from the slurry on a rotary evaporator and the residue dried in vacuo at 80° C. for 16 hours. The dried material was then placed in a dry box and ground to a particle size that would pass through a 20 mesh screen. This ground material was then charged to a Soxhlet thimble and extracted with tetrahydrofuran until the siphoned liquid was nearly colorless. The tetrahydrofuran, which contained the dissolved non-basic fraction, was removed from the collection flask. Pyridine was then added to the collection flask and the extraction carried out again until the siphoned liquid was nearly colorless. The pyridine fraction contained the dissolved basic fraction which was then also removed from the collection flask. The separated basic and non-basic fractions contained in the pyridine and tetrahydrofuran solutions, respectively, were isolated by evaporating the solvent and drying in vacuum at 80° C.

The results of this experiment are also shown in Table 1 and illustrate the fact that the solid acid catalysts selectively adsorb the basic asphaltenes from the mixture of basic and non-basic asphaltenes.

In order to further substantiate the fact that the solid acid catalyst selectively adsorbed the basic asphaltenes, a portion of both the basic and non-basic asphaltene fractions obtained by contacting the asphaltene-containing toluene solution with the DA-1 catalyst using the technique described above was redissolved in toluene and fractionated again using HCl according to the Sternberg technique. The results showed that the non-basic fraction obtained by the DA-1 separation was mostly non-basic according to the HCl test. Correspondingly, the basic asphaltene fraction was found to be mostly basic according to the HCl test.

EXAMPLE 2

In this experiment, samples of basic and non-basic asphaltene fractions obtained from coal liquids and separated by selective adsorption on the DA-1 catalyst using the technique set forth in Example 1 were analyzed by mass spectroscopy. The results indicated that the basic fraction had basic functional groups and that the non-basic fraction had acidic or neutral functional groups. Further, the mass spectroscopy studies indicated that the DA-1 catalyst did a better job of separating the basic and non-basic fractions than could be obtained using the HCl precipitation technique according to Sternberg.

EXAMPLE 3

This experiment serves to demonstrate that it is the acidity of the solid acid or solid acid catalyst which causes the selective adsorption and separation of the basic asphaltenes from the non-basic asphaltenes. This experiment was done in a manner similar to that in Example 1 except that the solid adsorbents used were the DA-1 and a neutral silica gel and the non-basic and basic asphaltenes were removed from the catalyst sequentially using the THF and pyridine using column chromatography at room temperature instead of the Soxhlet extraction. The results are presented in Table 2 and show that the acidic DA-1 gives a high yield of basic asphaltenes. In contrast, the neutral silica did not adsorb any basic asphaltenes at all.

EXAMPLE 4

This example serves to demonstrate that the solid acid can be heavily loaded with asphaltenes and still selectively adsorb basic asphaltenes from the basic/non-basic asphaltene mixture. This experiment was accomplished using a procedure similar to that in Example 1 wherein asphaltenes were dissolved in toluene which was then slurried with the catalyst followed by drying and crushing. The non-basic and basic asphaltenes were then removed from the catalyst using the column chromatography method in Example 3. The results are given in Table 3 and demonstrate that up to about 20 wt. % of total asphaltenes can be adsorbed on the solid acid without incurring any major change in the basic/non-basic cut point.

EXAMPLE 5

In this experiment, an elemental analysis was made of the basic and non-basic asphaltene fractions obtained by selectively adsorbing the basic fraction on the DA-1 catalyst using the procedure in Example 1. The asphaltenes used in this experiment were derived both from a Canadian Cold Lake crude and from the liquefaction product of Wyodak coal. The results of the analysis are shown in Table 4 and disclose that, with the possible exception of nitrogen content, there is essentially no difference in elemental analysis between the basic and non-basic fractions of each sample. However, both high resolution mass spectroscopy and electrochemical titration have shown that the nitrogen in the basic fraction is basic, while that in the non-basic fraction is non-basic. In the coal derived fractions, the nitrogen and oxygen actually fractionate. However, in this case, the acid phenolic oxygen and the non-basic nitrogen appear in the non-basic fraction, while the ether oxygen and basic nitrogen appear in the basic fraction. Thus, this establishes that elemental analysis alone does not give an indication of basicity.

EXAMPLE 6

This experiment demonstrates the sensitivity of the solid acid to moisture on the catalyst in the selective separation process of this invention. Samples of asphalt precipitated from both a Canadian Cold Lake crude and a Canadian Cold Lake 1050° F.+ vacuum resid were dissolved in toluene and slurried with samples of the DA-1 catalyst as-received from the manufacturer, and after being calcined at 500° C. Uncalcined catalysts generally contain from about 3–9 wt. % water, with 4–6% representing an average value. The asphalt-containing catalysts were then sequentially extracted with THF and pyridine using the procedure outlined in Example 1. The results of this experiment are shown in Table 5 and, as can be seen from the data, the yield of basic material using calcined DA-1 was substantially greater. This demonstrates that calcining the catalyst increased the adsorbtive capacity of the catalyst for the basic fraction.

TABLE 1

COMPARISON OF METHODS FOR SEPARATING BASIC ASPHALTENES

| Source of Asphaltenes | HCl Precip. wt. % | Solid Acid Adsorption wt. % DA-1 | Hi-Al |
|---|---|---|---|
| Tia Juana | 37.0 | 32.1 | 31.6 |
| Cold Lake | 25 | 32.8 | |

TABLE 2

THE EFFECT OF ADSORBENT ON BASIC ASPHALTENE SEPARATION*

| Source of Asphaltenes | Basic Asphaltene Yield, Wt. % DA-1 | SiGel |
|---|---|---|
| Tia Juana | 32.1 | 0 |
| Arab Heavy | 20.2 | — |

*Note: 10 wt. % initial loading of asphaltenes on the solid.

TABLE 3

THE EFFECT OF SOLIDS LOADING ON SEPARATION OF BASIC ASPHALTENES WITH DA-1

| | Loading, Wt. % Asphaltenes* on DA-1 | | |
|---|---|---|---|
| | 10 | 15 | 20 |
| Basic Asphaltene Yield, wt. % of Feed | 32.1 | 31.9 | 27.0–29.4 |

*NOTE: Asphaltenes from Tia Juana Medium crude oil.

TABLE 4

ELEMENTAL ANALYSIS OF COLD LAKE AND WYODAK ASPHALTENE FRACTIONS

| | COLD LAKE | | WYODAK | |
|---|---|---|---|---|
| | NON-BASIC | BASIC | NON-BASIC | BASIC |
| % C | 80.72 | 80.60 | 87.72 | 84.10 |
| % H | 7.79 | 7.59 | 6.41 | 6.31 |
| % N | 1.11 | 1.45 | 0.60 | 3.19 |
| % S | 7.76 | 7.65 | 0.60 | 0.60 |
| % O | 2.51 | 2.60 | 3.93 | 5.51 |
| V (PPM) | 813 | 770 | — | — |
| Ni (PPM) | 322 | 350 | — | — |

TABLE 5

Yields of Basic and Non-basic Cold Lake Asphaltenes from Calcined and As-received DA-1 Catalyst, wt. %

| Asphaltene Source | Catalyst | Non-Basic | Basic |
|---|---|---|---|
| Cold Lake Crude | Calcined | 62.4 | 37.6 |
| Cold Lake Crude | As-Received | 90.9 | 9.1 |
| Cold Lake Resid | Calcined | 62.1 | 37.9 |
| Cold Lake Resid | As-Received | 89.8 | 10.2 |

EXAMPLE 7

A 10 wt. % $WO_3$ on $\gamma$-$Al_2O_3$ (reforming grade of alumina obtained from Engelhard Industries, Inc. with a BET surface area of 220 $m^2/g$) catalyst was prepared using an aqueous solution of ammonium meta-tungstate sufficient to fill the pore volume of the alumina. The catalyst was dried in vacuo at 120° C. for 16 hours and then calcined in flowing air at 500° C. for 16 hours. This catalyst was used to separate the basic and non-basic asphaltenes which were recovered using the procedure described in Example 1, except that tetrahydropyran (THP) was used in place of tetrahydrofuran. The basic/non-basic asphaltene split obtained using this catalyst was 15/85. Following the removal of the non-basic and basic asphaltenes, the recovered catalyst was steamed for 16 hours at 900° C. in a tube furnace in an 80/20 helium/oxygen mixture sparged through water. The steamed catalyst was then calcined at 500° C. and a second asphaltene separation carried out.

In the second separation, the percentages of non-basic and basic asphaltenes were 82% and 18%, respectively. The non-basic fraction was recovered via Soxhlet extraction with THP and the amount of basic asphaltenes remaining on the catalyst was determined by the difference between the total amount of asphaltenes on the catalyst (20 wt. %) and the amount of recovered non-basic asphaltenes. The basic asphaltenes were then catalytically cracked off the catalyst at 550° C. to produce liquids, gas and a coked catalyst. The cracking was done by placing the basic asphaltene-laden catalyst in a quartz tube which was then inserted in a rapid pyrolysis unit which comprised a hot iron block. The coked catalyst was then regenerated using the 16 hour, 900° C. steaming treatment, calcined at 500° C. and used for a third separation, after which the catalyst was subjected to the Soxhlet extraction, asphaltene-cracking, steam regeneration and calcining steps used for the second separation. The calcined catalyst was then used for a fourth separation.

The third and fourth separations produced non-basic/basic yields of 67%/33% and 78%/22%, respectively. It should be noted that the Soxhlet extraction for the third separation was not done for as long a time as that for the first, second and fourth separations. This may explain the apparently greater yield of basic asphaltenes for the third separation.

This example serves to demonstrate the process of this invention and also shows that the basic asphaltene separation capacity of tungsten oxide on $\gamma$-$Al_2O_3$ is not reduced by a high temperature steaming treatment.

EXAMPLE 8

In this experiment a sample of the DA-1 silica-alumina catalyst described in Example 1 was steamed in a tube furnace for 16 hours at 900° C. in an 80/20 $He/O_2$ mixture sparged through water. This steaming treatment was designed to simulate steam gasification reaction conditions that would be used to remove coke from a catalyst. Following the steam treatment, the sample was calcined at 500° C. and then used to separate basic and non-basic asphaltenes from Cold Lake crude using the procedure described in Example 1. The basic/non-basic asphaltene split obtained using the steamed and calcined catalyst was 9/91 compared to 32/68 for a calcined sample of DA-1 that had not been steamed. This very low basic asphaltene adsorption capacity for a steamed silica-alumina catalyst compared to the unsteamed catalyst (Example 1) is due to the loss of acid centers for a high temperature steamed silica-alumina material. A steaming treatment similar to that described above, but with steaming temperature of 870° C., resulted in a reduction of $Ho \leqq 8.2$ type acid centers to 75 micromoles per gram ($\mu m/g$) [H. A. Benesi, J. Amer. Chem. Soc. 89, 5490 (1956)] compared to 425 $\mu m/g$ for an unsteamed sample.

This example serves to demonstrate the pronounced, irreversible reduction in strong acid centers with concomitant reduction in basic asphaltene adsorption capacity resulting from a high temperature steaming treatment of a conventional silica-alumina catalyst.

EXAMPLE 9

A sample of a pyrogenic $\gamma$-$Al_2O_3$ was obtained from Degussa (Aluminum Oxide C). This alumina is produced by the flame hydrolysis of anhydrous aluminum chloride, is primarily $\gamma$-$Al_2O_3$ and has a BET surface area of 100 $m^2/g$. A catalyst comprising 10 wt. % $WO_3$ on this alumina was prepared using an aqueous solution of ammonium metatungstate sufficient to fill the pore volume of alumina. The catalyst was dried in air, at 120° C. for 16 hours and then calcined in flowing air at 500° C. for 16 hours. As in Example 7, this catalyst was used to separate basic and non-basic asphaltenes from Cold Lake crude using the procedure described in Example 1 (except that tetrahydropyran was substituted for tetrahydrofuran). The percentages of basic and non-basic asphaltenes recovered using this catalyst were 28% and 72%, respectively.

Following the asphaltene separation and removal from the catalyst, the recovered catalyst was steamed in a tube furnace for 16 hours at 900° C. in an 80/20 $He/O_2$ mixture sparged through water. The steamed catalyst was then calcined at 500° C. and a second asphaltene, separation was carried out. In the second separation, the percentages of non-basic and basic asphaltenes were 64% and 36% respectively. The non-basic fraction was recovered via Soxhlet extraction with THP and the amount of basic asphaltenes remaining on the catalyst was determined by the difference between the total amount of asphaltenes on the catalyst (20 wt. %) and the amount of recovered non-basic asphaltenes. The basic asphaltenes were then catalytically cracked off the catalyst at 550° C. to produce liquids, gas and a coked catalyst. The cracking was done by placing the basic asphaltene-laden catalyst in a quartz tube which was then inserted in a rapid pyrolysis unit which comprised a hot iron block. The coked catalyst was then regenerated using the 16 hours, 900° C. steaming treatment, calcined at 500° C. and used for a third separation which produced a basic/non-basic asphaltene split of 37/63.

This experiment demonstrates the process of this invention and shows that not only is the basic asphaltene adsorption capacity of a catalyst of this invention higher than that for a similar catalyst on a conventional $\gamma$-$Al_2O_3$ support (Example 7), but the adsorption capacity for basic asphaltenes is significantly increased by a high temperature steaming treatment.

EXAMPLE 10

In this experiment, Cold Lake asphaltenes were deposited onto the surface of a number of different catalysts in an amount of 20 wt. % of each catalyst by adding the catalyst to a solution of the asphaltenes in toluene under a blanket of nitrogen, followed by removing the toluene in a rotary evaporator, drying in vacuo at 80° C. and grinding to a 20 mesh particle size following the procedure in Example 1. The activity and selectivity of each catalyst for crackng off the asphaltenes was determined using the rapid pyrolysis technique set forth in Examples 7 and 9 wherein the asphaltenes were catalytically cracked off at 550° C. The results are shown in Table 6.

These data show that the catalyst which produced the greatest amount of liquid product from the Cold Lake asphaltenes was tungsten oxide on the pyrogenic alumina (Degussa Aluminum Oxide C).

TABLE 6

| Catalyst | Catalyst Pretreatment | % Liquids | % Coke |
|---|---|---|---|
| None | — | 27 | 61 |
| 10% $WO_3$ on $\gamma$-$Al_2O_3$ | Calcined at 500° C. | 30 | 60 |
| 10% $WO_3$ on $\gamma$-$Al_2O_3$ | 20% $O_2$ in He Steamed at 900° C. then calcined at 500° C. | 32 | 58 |
| Silica-Alumina | Calcined at 500° C. | 32 | 58 |
| 10% $WO_3$ on pyrogenic $\gamma$-$Al_2O_3$* | Calcined at 500° C. | 35 | 54 |

*Degussa Aluminum Oxide C

What is claimed is:

1. A process for selectively removing basic asphaltenes from a basic asphaltene-containing hydrocarbon feed which comprises contacting said feed, in an adsorption zone, with a fresh or regenerated solid acid catalyst having primarily Bronsted acidity, said catalyst comprising at least one catalytic metal oxide selected from the group consisting of the oxides of (a) tungsten, niobium and mixtures thereof and (b) mixtures of (a) with tantalum, hafnium, chromium, titanium, zirconium and mixtures thereof supported on an pyrogenic alumina support, for a time sufficient to adsorb at least a portion of said basic asphaltenes from said feed to produce a feed of reduced basic asphaltene content.

2. The process of claim 1 wherein said pyrogenic alumina is a gamma alumina.

3. The process of claim 2 wherein said support contains silica in an amount less than about 50% of the alumina content thereof.

4. The process of claim 2 wherein said pyrogenic alumina is formed by the flame hydrolysis of aluminum chloride.

5. The process of either of claims 3 or 4 wherein said catalyst is steamed at a temperature at least about 600° C. prior to being contacted with said feed.

6. The process of claim 5 wherein said catlyst contains a promoter material comprising at least one Group IIA metal oxide.

7. The process of claim 6 wherein said promoter material is at least one oxide selected from the group consisting of oxides of barium, calcium, strontium and mixtures thereof.

8. The process of claim 7 wherein said feed has a moisture content less than the basic asphaltene content thereof.

9. A process for selectively removing basic asphaltenes from a basic asphaltene-containing hydrocarbon feed which comprises contacting said feed, in an adsorption zone and at a temperature below about 575° F., with a fresh or regenerated solid acid catalyst comprising at least one catalytic metal oxide selected from the group consisting of the oxides of (a) tungsten, niobium and mixtures thereof and (b) mixtures of (a) with tantalum, hafnium, chromium, titanium, zirconium and mixtures thereof supported on a pyrogenic alumina support, for a time sufficient to adsorb at least a portion of said basic asphaltenes from said feed to produce a feed of reduced basic asphaltene content.

10. The process of claim 9 wherein the basic asphaltene-laden catalyst is separated from the feed, the basic asphaltenes are cracked off the catalyst and the catalyst is regenerated.

11. The process of claim 10 wherein at least a portion of the asphaltene crackates are liquid hydrocarbons.

12. The process of claim 11 wherein said pyrogenic alumina comprises a gamma alumina.

13. The process of claim 12 wherein said pyrogenic alumina is formed by the flame hydrolysis of aluminum chloride.

14. The process of claim 11 wherein said support comprises a mixture of silica and pyrogenic alumina, and wherein the silica content thereof is less than about 50% of the alumina content thereof.

15. The process of either of claims 11 or 14 wherein the asphaltenes are cracked off the catalyst in the presence of steam.

16. The process of claim 15 wherein said catalyst is steamed at a temperature of at least 600° C. prior to being contacted with said feed.

17. The process of claim 15 wherein said catalyst is promoted with a promoter material comprising at least one Group IIA metal oxide.

18. The process of claim 17 wherein said promoter material is selected from the group consisting essentially of oxides of barium, calcium, strontium and mixtures thereof.

19. The process of claim 18 wherein the moisture content of said feed is less than the basic asphaltene content thereof.

* * * * *